US005484085A

United States Patent [19]

Bennett

[11] Patent Number: 5,484,085

[45] Date of Patent: Jan. 16, 1996

[54] WRIST-CARRIABLE PROTECTIVE SPRAYER

[76] Inventor: David Bennett, Box 1481, Port Hardy, British Columbia, Canada, V0N 2P0

[21] Appl. No.: 412,999

[22] Filed: Mar. 29, 1995

[51] Int. Cl.[6] ..... B67D 5/64

[52] U.S. Cl. ..... 222/175; 222/183; 222/530; 239/154

[58] Field of Search ..... 222/175, 183, 222/526–530, 192, 402.1, 394; 224/148; 239/154, 529, 153, 152

[56] References Cited

U.S. PATENT DOCUMENTS

| | | | |
|---|---|---|---|
| 1,885,180 | 11/1932 | Cameron | 222/175 |
| 2,192,082 | 2/1940 | Hunicke | 222/175 |
| 3,445,046 | 5/1969 | Wilson | 222/175 X |
| 3,523,645 | 8/1970 | Beauchamp | 239/154 |
| 4,407,454 | 10/1983 | Massey | 239/154 |
| 5,072,856 | 12/1991 | Kimble | 239/529 X |
| 5,088,624 | 2/1992 | Hackett et al. | 222/175 X |
| 5,111,968 | 5/1992 | Wilkerson | 222/175 X |

*Primary Examiner*—Kevin P. Shaver

[57] ABSTRACT

A wrist-carriable protective sprayer including a closeable carrying pouch; a coupling mechanism for coupling the carrying pouch to a forearm of a user; a canister of pressurized protective spray disposed within the carrying pouch; an elongated guide rail; a guiding bracket coupled to the pouch and slidably coupled to the guide rail and allowing longitudinal movement of the guide rail with respect to the user's forearm; a finger holding mechanism coupled to an end of the guide rail for allowing a firm hold by at least one finger of the user; an actuatable spray nozzle coupled to the guide rail; and a section of tubing coupled between the canister and the spray nozzle; whereby when the pouch is secured to a user's forearm and the spray nozzle is positioned in juxtaposition with the user's wrist to thereby define a stowed configuration, positioning of one of the fingers of a user within the finger holding mechanism and subsequent extension of such fingers allows the spray nozzle to be pulled to an operable position for actuation by the user's thumb and or finger.

4 Claims, 4 Drawing Sheets

10
100
36
12
120

90
70
52
50
94
114
54

FIG. 5
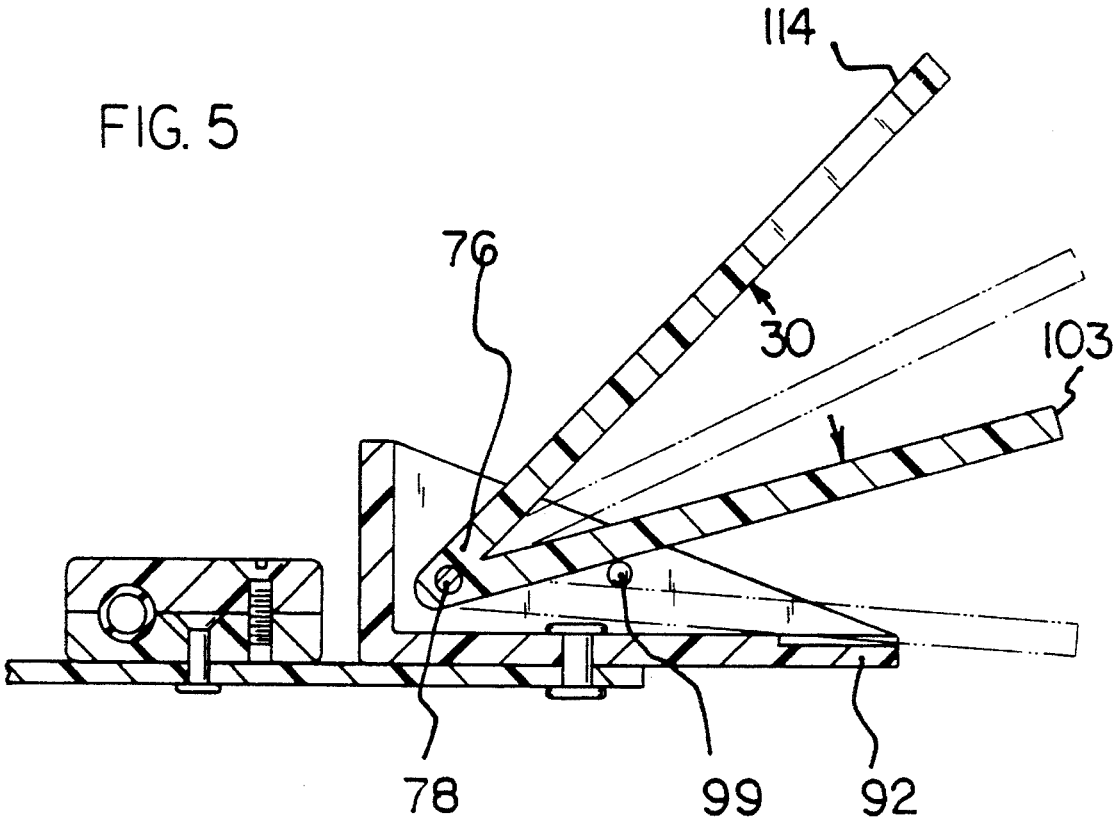
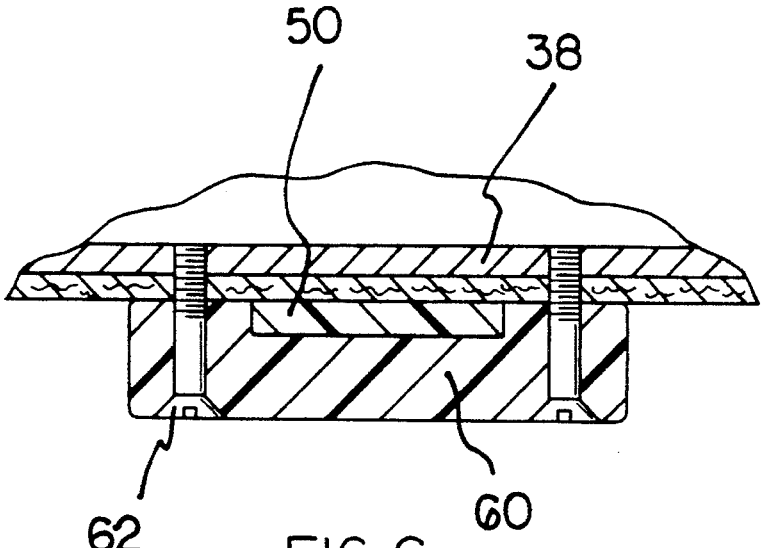
FIG. 6

FIG. 7
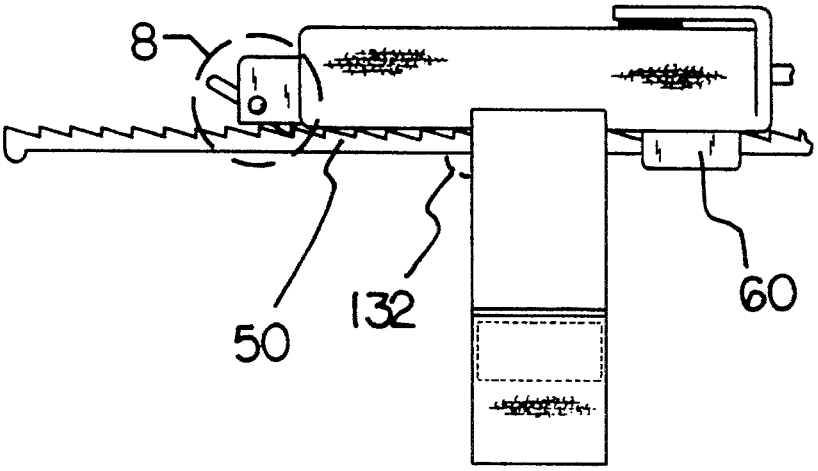
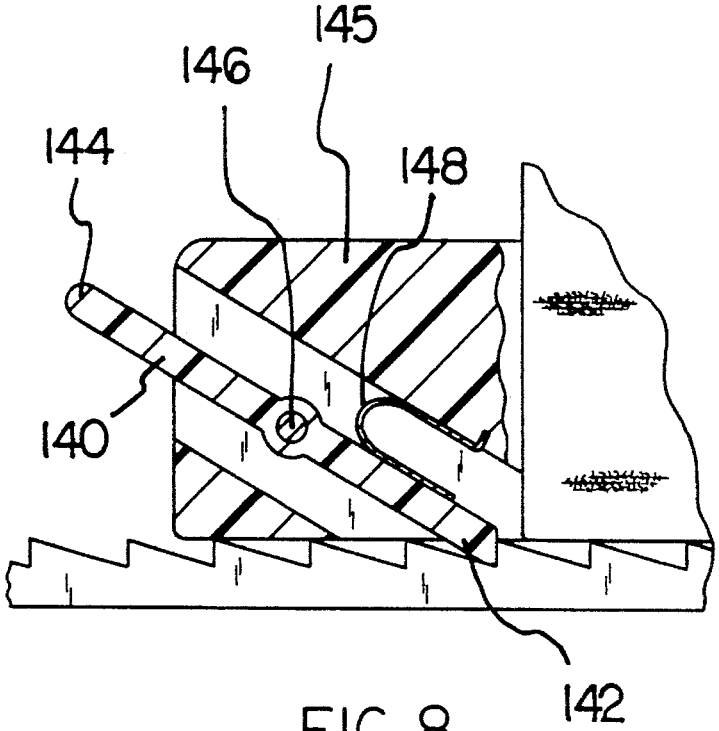
FIG. 8

WRIST-CARRIABLE PROTECTIVE SPRAYER

BACKGROUND OF THE INVENTION

1. Field of the Invention

The present invention relates to a wrist-carriable protective sprayer and more particularly pertains to allowing protective spray to be carried in a proximal concealed location for its ready use as required with a wrist-carriable protective sprayer.

2. Description of the Prior Art

The use of protective spray mechanisms is known in the prior art. More specifically, protective spray mechanisms heretofore devised and utilized for the purpose of allowing protective spray to be carried at a location for ready use are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,186,851 to Cantor discloses a non-lethal personal defense weapon. U.S. Pat. No. 4,223,804 to Morris et al. discloses a personal defense device. U.S. Pat. No. 4,434,914 to Meshberg discloses a personal defense actuator. U.S. Pat. No. 4,446,990 to Stevenson et al. discloses a self-defense spray device. U.S. Pat. No. 4,997,110 to Swenson discloses a concealable watershooter. U.S. Pat. No. 5,289,164 to Novak discloses a glove-type holder for a security device.

While these devices fulfill their respective, particular objective and requirements, the aforementioned patents do not describe a wrist-carriable protective sprayer that allows protective spray to be concealed and readily accessed when needed.

In this respect, the wrist-carriable protective sprayer according to the present invention substantially departs from the conventional concepts and designs of the prior art, and in doing so provides an apparatus primarily developed for the purpose of allowing protective spray to be carried in a proximal concealed location for its ready use as required.

Therefore, it can be appreciated that there exists a continuing need for new and improved wrist-carriable protective sprayer which can be used for allowing protective spray to be carried in a proximal concealed location for its ready use as required. In this regard, the present invention substantially fulfills this need.

SUMMARY OF THE INVENTION

In the view of the foregoing disadvantages inherent in the known types of protective spray mechanisms now present in the prior art, the present invention provides an improved wrist-carriable protective sprayer. As such, the general purpose of the present invention, which will be described subsequently in greater detail, is to provide a new and improved wrist-carriable protective sprayer and method which has all the advantages of the prior art and none of the disadvantages.

To attain this, the present invention essentially comprises, in combination, a carrying pouch having a central axis, a front wall with a pile-type fastener coupled thereto, a rear wall, and a generally U-shaped peripheral side wall interconnecting the front wall and the rear wall to define a hollow interior and a central top opening for allowing access to the interior. The pouch further has a flap with a complimentary pile-type fastener coupled thereto. The fasteners of the front wall and the flap are removably secured together for sealing the opening and thereby precluding access to the interior. The carrying pouch additionally has a first strap with an inboard end coupled to the side wall and an outboard end with a pile-type fastener coupled thereto, a second strap with an inboard end coupled to the side wall at a location opposite the first strap and an inboard end with a complimentary pile-type fastener coupled thereto and with the fasteners of the straps removably secured together in a closed loop configuration about a forearm of a user. A canister of pressurized protective spray is included and removably disposed within the pouch. The canister has a valve coupled thereto for allowing the protective spray to be dispersed. An elongated guide rail is included and has an inboard end, an outboard end, and a central axis positioned in parallel relation with the central axis of the pouch at a location adjacent to the bottom wall. A guiding bracket is included and coupled to the pouch and/or canister. The guiding bracket is also slidably coupled to the guide rail. The guiding bracket allows movement of the guide rail along an axis coincident with its central axis and longitudinal movement with respect to the user's forearm. A finger grip is provided and has a V-shaped cross-section formed of a generally rectangular long plate interconnected with a generally rectangular short plate at an apex and with the long plate having an aperture formed thereon sized for receipt of both a middle finger and a ring finger of the user. A base bracket is included and coupled to the outboard end of the guide rail and pivotally coupled to the apex of the finger grip. A depressible spray nozzle is provided and coupled to the guide rail at a location proximal to the base bracket. A section of flexible tubing is included and coupled between the valve of the canister and the spray nozzle and with depression of the spray nozzle allowing protective spray to be expelled from the nozzle to a remote location. When the pouch is secured to the user's forearm and the spray nozzle is positioned in juxtaposition with the user's wrist to thereby define a stowed configuration, positioning of the user's fingers within the aperture of the finger grip and subsequent extension of such fingers allows the spray nozzle to be pulled to an operable position for depression by the user's thumb, thereby allowing disbursement of protective spray.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wrist-carriable protective sprayer which has all the advantages of the prior art protective spray mechanisms and none of the disadvantages.

It is another object of the present invention to provide a new and improved wrist-carriable protective sprayer which may be easily and efficiently manufactured and marketed.

It is a further object of the present invention to provide a new and improved wrist-carriable protective sprayer which is of durable and reliable construction.

An even further object of the present invention is to provide a new and improved wrist-carriable protective sprayer which is susceptible of a low cost of manufacture with regard to both materials and labor, and which accordingly is then susceptible of low prices of sale to the consuming public, thereby making such a wrist-carriable protective sprayer economically available to the buying public.

Still yet another object of the present invention is to provide a new and improved wrist-carriable protective sprayer which provides in the apparatuses and methods of the prior art some of the advantages thereof, while simultaneously overcoming some of the disadvantages normally associated therewith.

Even still another object of the present invention is to provide a new and improved wrist-carriable protective sprayer for allowing protective spray to be carried in a proximal concealed location for its ready use as required.

Lastly, it is an object of the present invention to provide a new and improved wrist-carriable protective sprayer comprising a closeable carrying pouch; coupling means for coupling the carrying pouch to a forearm of a user; a canister of pressurized protective spray disposed within the carrying pouch; an elongated guide rail; a guiding bracket coupled to the pouch and slidably coupled to the guide rail and with the guiding bracket allowing longitudinal movement of the guide rail with respect to the user's forearm; finger holding means coupled to an end of the guide rail for allowing a firm hold by at least one finger of the user; an actuatable spray nozzle coupled to the guide rail at a location proximal to the finger gripping means; and a section of tubing coupled between the canister and the spray nozzle; whereby when the pouch is secured to a user's forearm and the spray nozzle is positioned in juxtaposition with the user's wrist to thereby define a stowed configuration, positioning of one of the fingers of a user within the finger holding means and subsequent extension of such fingers allows the spray nozzle to be pulled to an operable position for actuation by the user's thumb, thereby allowing disbursement of protective spray.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view of the present invention taken along the line 5—5 of FIG. 3.

FIG. 6 is a cross-sectional view of the present invention taken along the line 6—6 of FIG. 4.

FIG. 7 is a side-elevational view of an alternate embodiment of the present invention.

FIG. 8 is an enlarged fragmentary view of a portion of the alternate embodiment of the present invention as shown in FIG. 7.

The same reference numerals refer to the same parts through the various Figures.

DESCRIPTION OF THE PREFERRED EMBODIMENT

Figure 1:
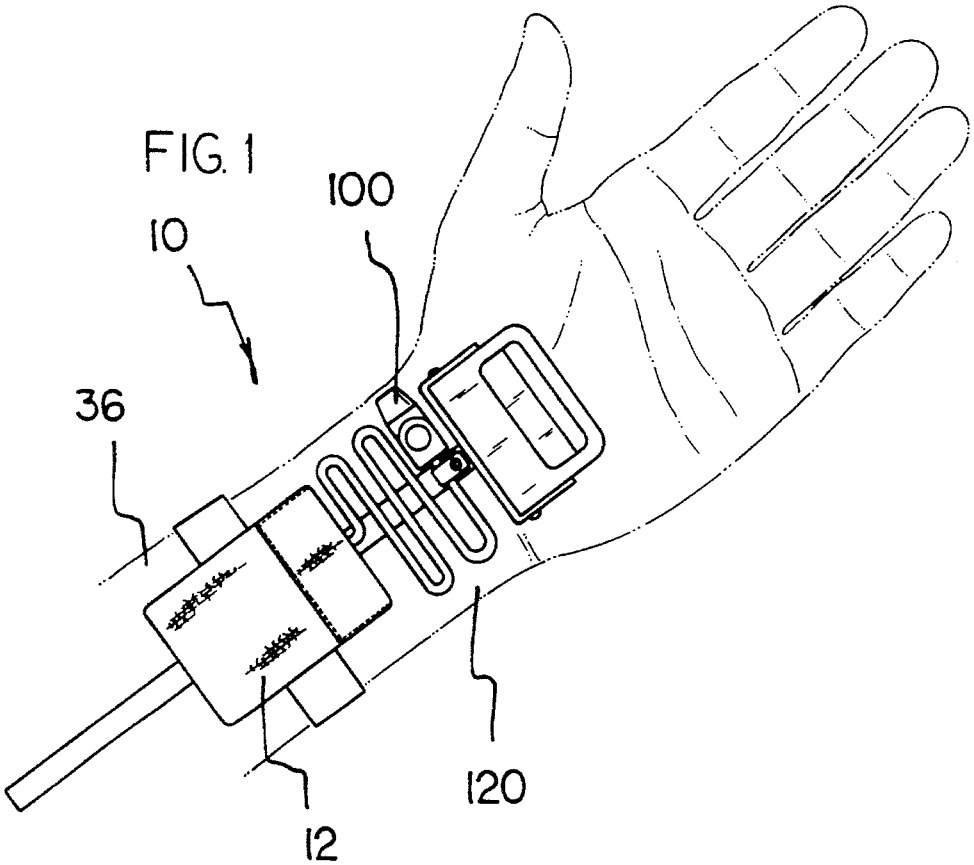
FIG. 1 is a side-elevational view of the preferred embodiment constructed in accordance with the principles of the present invention positioned in a retracted stowed configuration.
Figure 2:
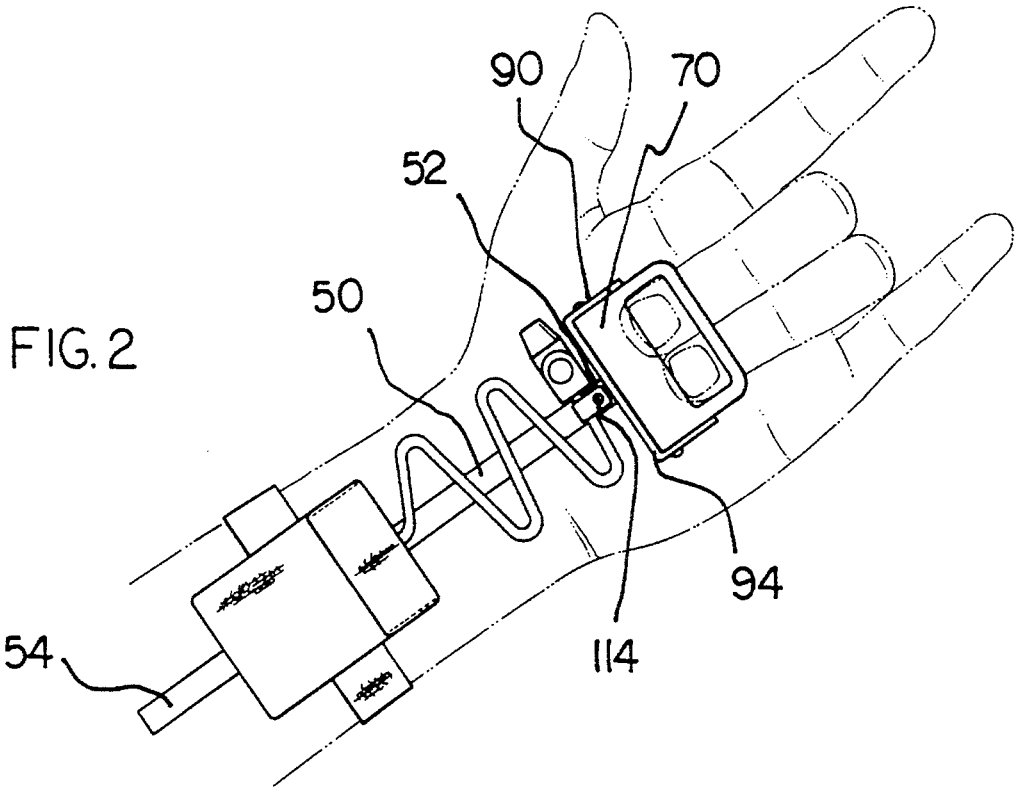
FIG. 2 is a side-elevational view of the present invention being extended to an operable configuration through pulling action applied by two fingers extended within the finger grip.
Figure 3:
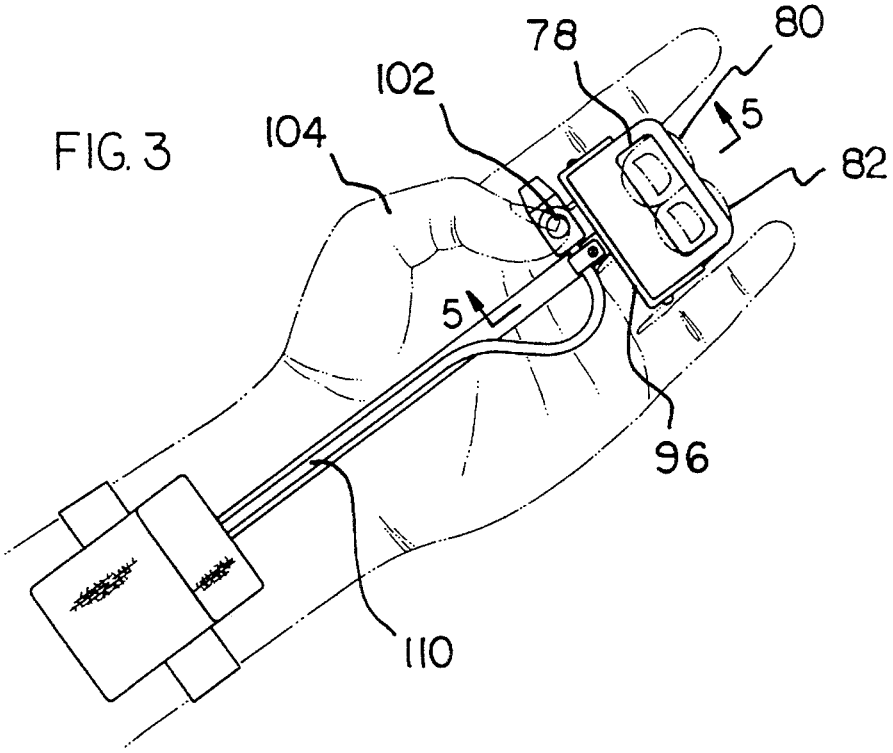
FIG. 3 is another side-elevational view of the present invention with final movement of the fingers placing the present invention in an operable configuration for allowing depression of the spray nozzle with a thumb and/or finger.
Figure 4:
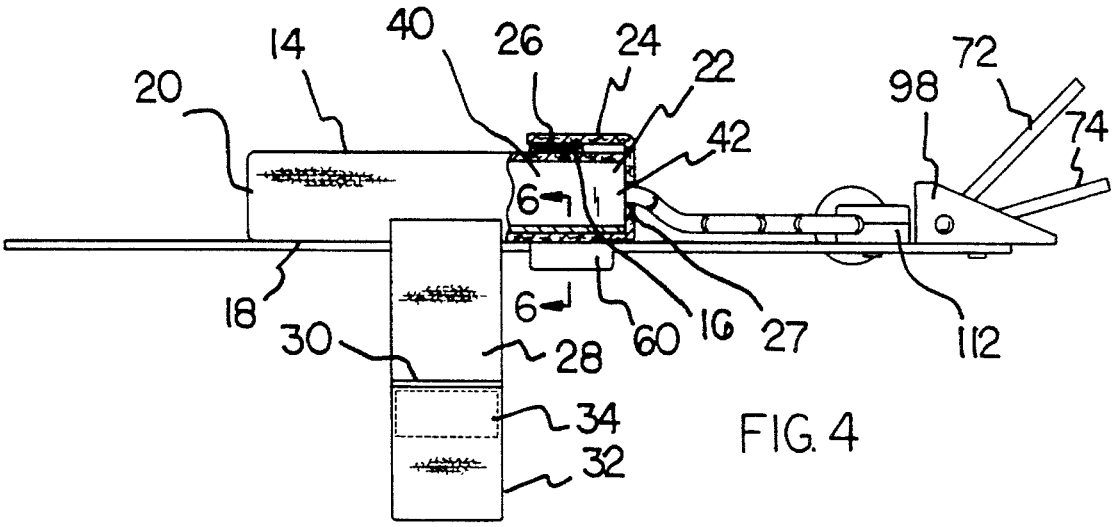
FIG. 4 is a view of the present invention when decoupled from a user.

With reference now to the drawings, and in particular, to FIG. 1 thereof, the preferred embodiment of the new and improved wrist-carriable protective sprayer embodying the principles and concepts of the present invention and generally designated by the reference number 10 will be described.

The preferred embodiment of the present invention comprises a plurality of components. In their broadest context, such components include a pouch, canister, guide rail, guiding bracket, fingergrip, base bracket, spray nozzle, and tubing. Such components are individually configured and correlated with respect to each other to provide a wrist-carriable protective sprayer that allows protective spray to be carried in a proximal concealed location for its ready use as required.

Specifically, the present invention includes a carrying pouch 12. The carrying pouch is formed of a flexible fabric material such as canvas. The carrying pouch has a central axis, a front wall 14 with a pile-type fastener 16 coupled thereto, a rear wall 18, and a generally U-shaped peripheral side wall 20 formed of two opposed side portions with an end portion extended therebetween. The side wall 20 interconnects the front wall and the rear wall to define a hollow interior and a central top opening 22 for allowing access to the interior. The pouch also includes a flap 24 with a complimentary pile-type fastener 26 coupled thereto. The pouch is positioned over the central opening with the fasteners of the front wall and the flap removably secured together for sealing the opening and thereby precluding access to the interior. The flap also has a through hole 27 formed centrally thereon.

The carrying pouch additionally includes a first strap 28. The first strap has an inboard end sewn to the side wall and an outboard end with a pile-type fastener 30 sewn thereto. Also provided is a second strap 32 with an inboard end sewn to the side wall at a location opposite the first strap and an inboard end with a complimentary pile-type fastener 34 sewn thereto. The fasteners of the straps are removably secured together in a closed loop configuration about a forearm 36 of a user. The pouch also includes a rigid backing 38 coupled to the rear wall at a location adjacent to the interior. The backing provides increased rigidity to the pouch.

Removably disposed within the pouch is a canister 40. The canister contains pressurized protective spray. The canister has a low profile and is shaped to fit a forearm and wrist of a user. The profile of the canister is such that it can be positioned against a forearm of a user and then covered with clothing to appear essentially unnoticeable. The canister has a valve 42 coupled thereto. The valve is conventional in design and allows the spray within the canister to be readily dispersed.

Also included is a guide rail 50. The guide rail is elongated in structure. It has an inboard end 52, an outboard end 54 and a central axis. The central axis of the guide rail is positioned in parallel relation with the central axis of the pouch at a location adjacent to the rear wall 18. The guide rail is also positionable in general parallel relation with the forearm 36 of the user.

A guiding bracket 60 is coupled to the pouch 12 and further slidably coupled to the guide rod. The guiding bracket is rigid in structure. The guiding bracket allows movement of the guide rail along an axis coincident with its central axis. The guiding bracket also allows longitudinal movement of the guide rail with respect to the user's forearm. The guiding bracket is secured to the rear wall 18 and backing 38 with threaded fasteners 62.

To effect longitudinal movement of the guide rail with respect to the user's forearm, a fingergrip 70 is provided. The fingergrip has a generally V-shaped cross-section formed of a generally rigid rectangular long plate 72 interconnected with a generally rigid rectangular short plate 74 at an apex 76. The plates define an angle of approximately 30 degrees therebetween. Each plate essentially has the same width, but the long plate is approximately 10% longer than the short plate. The long plate has a generally rectangular aperture 48 formed thereon. This aperture is sized for receipt of both a middle finger 80 and a ring finger 82 of the user.

A rigid base bracket 90 is coupled to the outboard end 52 of the guide rail. The base bracket is also pivotally coupled to the apex 76 of the fingergrip with a pivot pin 78. The base bracket includes a planar bottom wall 92 and a U-shaped side wall 94 extended upwards therefrom. Side wall 94 is formed of a central portion 96 with a pair of generally triangular end portions 98 coupled thereto. A depressible dimple 99 allows the long plate to be positioned in facing contact with the bottom wall 92 in an engaged orientation or allows the long plate 72 to be positioned at an angle away from the bottom wall 92 in a disengaged orientation as shown in FIG. 5.

Also provided is a spray nozzle 100. Spray nozzle 100 is coupled to the guide rail at a location proximal to the base bracket 90. The spray nozzle also includes a trigger 102 projected outwards therefrom and an inlet. The trigger is actuatable through depression by a user's thumb 104 for allowing protective spray to be dispersed. Different types of spray nozzles may be utilized for generating streams or clouds of spray.

Lastly, a section of flexible elastomeric tubing 106 is provided. One end of the tubing is disposed within the through hole 27 on the flap and coupled to the valve 42 of the canister. The other end of the tubing is coupled to the inlet of the spray nozzle 100. A clamp 112 with fastener 114 secures the tubing to the guide rail 50. Depression of the spray nozzle through trigger 102 allows protective spray to be expelled from the nozzle to a remote location.

To operate the present invention, the pouch 12 with canister is first secured to a user's forearm with the spray nozzle 100 positioned in juxtaposition with the user's wrist 120 to thereby define a stowed configuration. To extend the spray nozzle to an operable position for use, the user first positions fingers 80, 82 within the aperture of the fingergrip. Next, the user extends such fingers outwards and away from his wrist to thereby allow the spray nozzle to be pulled forward to a location such that the trigger 102 can be depressed by a thumb 104. When such depression occurs, disbursement of protective spray from the canister 40 commences. The user can then push the fingergrip back to the stowed configuration with his fingers.

A second embodiment of the present invention is shown in FIGS. 5 and 6. This embodiment includes substantially all of the components of the present invention and further includes a mechanism for preventing inadvertent retraction of the spray nozzle back to a stowed configuration or other undesired position. Such mechanism includes plurality of teeth 130 projected upwards from the guide rail. In addition, a stop 132 is formed on the guide rail and is engagable with the guiding bracket 60. The pouch includes a pawl 140 coupled thereto. One end 142 of the pawl is operatively engaged with the teeth of the guide rod is ratcheting relation for preventing inadvertent retraction of the spray nozzle. Another end 144 of the pawl can be depressed for removing end 142 from the teeth. The pawl is pivotally coupled to a housing 145 with a pivot pin 146. A spring 148 biases the end 142 for engagement with the teeth 130.

The present invention allows protective spray to be carried without being obvious or easily knocked out of a user's hand and, at the same time, provides rapid and easy access for operation of such protective spray in self-defense. The present invention includes a pouch which is held in place with fasteners. A nozzle on the container leads to a section of flexible tubing terminating in a finger operated spray valve. This tubing is held in place by both the pouch and a clasp. When retracted, the spray valve is positioned away from the palm of a user's hand. On closing of the hand, the second and third fingers are positionable within the aperture of the finger grip. Extension of the fingers then pulls the guide rail outwards such that the spray valve is positioned at a proximal location near a user's thumb. The position of the present invention can be adjusted to suit different-sized hands and lengths of forearms.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A wrist-carriable protective sprayer for allowing protective spray to be carried in a proximal concealed location for its ready use as required comprising, in combination:

a carrying pouch having a central axis, a front wall with a pile-type fastener coupled thereto, a rear wall, and a generally U-shaped peripheral side wall interconnecting the front wall and the rear wall to define a hollow interior and a central top opening for allowing access to the interior, the pouch further having a flap with a complimentary pile-type fastener coupled thereto and with the fasteners of the front wall and the flap removably secured together for sealing the opening and thereby precluding access to the interior, the carrying pouch additionally having a first strap with an inboard end coupled to the side wall and an outboard end with a pile-type fastener coupled thereto, a second strap with an inboard end coupled to the side wall at a location opposite the first strap and an inboard end with a complimentary pile-type fastener coupled thereto and with the fasteners of the straps removably secured together in a closed loop configuration about a forearm of a user;

a canister of pressurized protective spray removably disposed within the pouch and with the canister having a valve coupled thereto for allowing the spray to be dispersed;

an elongated guide rail having an inboard end, an outboard end, and a central axis positioned in parallel relation with the central axis of the pouch at a location adjacent to the bottom wall thereof;

a guiding bracket coupled to at least one of the pouch or canister and slidably coupled to the guide rail and with the guiding bracket allowing movement of the guide rail along an axis coincident with its central axis and longitudinal movement with respect to the user's forearm;

a finger grip having a V-shaped cross-section formed of a generally rectangular long plate interconnected with a generally rectangular short plate at an apex and with the long plate having an aperture formed thereon sized for receipt of both a middle finger and a ring finger of the user;

a base bracket coupled to the outboard end of the guide rail and pivotally coupled to the apex of the finger grip;

a depressible spray nozzle coupled to the guide rail at a location proximal to the base bracket;

a section of flexible tubing coupled between the valve of the canister and the spray nozzle and with depression of the spray nozzle allowing protective spray to be expelled from the nozzle to a remote location;

whereby when the pouch is secured to the user's forearm and the spray nozzle is positioned in juxtaposition with the user's wrist to thereby define a stowed configuration, positioning of the user's fingers within the aperture of the finger grip and subsequent extension of such fingers allows the spray nozzle to be pulled to an operable position for depression by at least one of the user's thumb or finger, thereby allowing disbursement of protective spray.

2. A wrist-carriable protective sprayer comprising:

a closeable carrying pouch;

coupling means for coupling the carrying pouch to a forearm of a user;

a canister of pressurized protective spray disposed within the carrying pouch;

an elongated guide rail;

a guiding bracket coupled to the pouch and slidably coupled to the guide rail and with the guiding bracket allowing longitudinal movement of the guide rail with respect to the user's forearm;

finger holding means coupled to an end of the guide rail for allowing a firm hold by at least one finger of the user;

an actuatable spray nozzle coupled to the guide rail at a location proximal to the finger gripping means; and a section of tubing coupled between the canister and the spray nozzle;

whereby when the pouch is secured to a user's forearm and the spray nozzle is positioned in juxtaposition with the user's wrist to thereby define a stowed configuration, positioning of one of the fingers of a user within the finger holding means and subsequent extension of such fingers allows the spray nozzle to be pulled to an operable position for actuation by at least one of the user's thumb or finger, thereby allowing disbursement of protective spray.

3. The wrist-carriable protective sprayer as set forth in claim 2 wherein the finger holding means comprises:

a finger grip having a V-shaped cross-section formed of a generally rectangular long plate interconnected with a generally rectangular short plate at an apex and with the long plate having an aperture formed thereon sized for receipt of both a middle finger and a ring finger of the user; and a base bracket coupled to the guide rail and pivotally coupled to the apex of the finger grip.

4. The wrist-carriable protective sprayer as set forth in claim 2:

wherein the guide rail has a plurality of teeth projected upwards therefrom; and wherein the pouch includes a pawl coupled thereto and with the pawl operatively engaging the teeth of the guide rail in ratcheting relation for preventing inadvertent retraction of the spray nozzle.

* * * * *